United States Patent [19]

Lively

[11] Patent Number: 4,916,959

[45] Date of Patent: Apr. 17, 1990

[54] LONG STROKE WELL PUMPING UNIT WITH CARRIAGE

[75] Inventor: Gordon R. Lively, P.O. Box 3164, Longview, Tex. 75606

[73] Assignee: Gordon R. Lively, Longview, Tex.

[21] Appl. No.: 158,678

[22] Filed: Feb. 22, 1988

[51] Int. Cl.[4] ..... B66B 5/26

[52] U.S. Cl. ..... 74/37; 74/89.21

[58] Field of Search ..... 74/37, 584, 590, 89.21

[56] References Cited

U.S. PATENT DOCUMENTS

| | | | |
|---|---|---|---|
| 1,512,726 | 10/1926 | Turnsek | 74/37 |
| 1,599,395 | 9/1926 | Hards | 74/37 |
| 1,637,078 | 7/1927 | Hill | 74/37 |
| 1,708,577 | 4/1929 | Hunter | 74/37 |
| 1,756,089 | 4/1930 | Hunter | 74/37 |
| 1,787,164 | 12/1930 | Parkin | 74/37 |
| 1,848,530 | 3/1932 | Hunter | 74/37 |
| 1,970,620 | 8/1934 | Park | 74/37 |
| 2,292,427 | 8/1942 | Blackburn | 74/37 |
| 2,351,183 | 6/1944 | Blackburn | 74/37 |
| 2,520,187 | 8/1950 | Wilshusen et al. | 74/37 |
| 2,522,742 | 9/1950 | Blackburn | 74/37 |
| 2,544,484 | 3/1951 | Blackburn | 74/37 |
| 2,544,485 | 3/1951 | Blackburn | 74/37 |
| 2,555,574 | 6/1951 | Crawford | 74/37 |
| 2,564,816 | 8/1951 | Rehwald | 74/37 |
| 2,815,901 | 10/1957 | Hale | 74/37 |
| 2,977,808 | 4/1961 | Dobbs | 74/37 |
| 2,987,928 | 6/1961 | Tedford | 74/37 |
| 3,153,387 | 10/1964 | Sadouet | 74/37 |
| 3,279,266 | 10/1966 | Dobbs | 74/37 |
| 4,519,262 | 5/1985 | Le et al. | 74/89.2 |
| 4,651,582 | 3/1987 | Bender | 74/89.22 |

FOREIGN PATENT DOCUMENTS

| | | | |
|---|---|---|---|
| 103377 | 1/1926 | Austria | 74/37 |

*Primary Examiner*—Gary L. Smith
*Assistant Examiner*—F. Saether
*Attorney, Agent, or Firm*—Roylance, Abrams, Berdo & Goodman

[57] ABSTRACT

A long stroke well pumping unit including a drive motor, a pulley and band assembly, a carriage assembly, a counterweight assembly and a belt and pulley assembly. The pulley and band assembly includes first and second pulleys and a continuous band which extends between and engages the pulleys. One of the pulleys is driven by the drive motor. The pulleys are spaced vertically. The carriage assembly includes a block base, wheels rotatably attached to the block base and an outer frame. The block base is swivelly connected to the continuous band. The wheels rotatably engage the interior of the frame. The counterweight assembly is fixedly attached to the frame. The belt and pulley assembly has first and second ends, the first end being attached to the counterweight and the second being attachable to a polish rod assembly. As the well pumping unit operates, the drive motor drives the band around the pulleys. Since the block base is connected to the band, it also travels in a loop around the pulleys. This causes the carriage assembly, and thus the counterweight assembly and the polish rod assembly to be driven in a vertical reciprocating motion. During this movement, the block base and wheels move back and forth within the frame.

26 Claims, 4 Drawing Sheets

LONG STROKE WELL PUMPING UNIT WITH CARRIAGE

FIELD OF THE INVENTION

This invention relates to long stroke well pumping units including reciprocating polish rod assemblies and counterweight assemblies to balance the weight of the polish rod assemblies during operation of the pumping units. More particularly, this invention relates to such well pumping units wherein the counterweight assemblies are directly driven by the drive mechanisms and the polish rod assemblies are attached to the counterweight assemblies.

BACKGROUND OF THE INVENTION

Well pumping units have traditionally included a drive mechanism having an output of rotary motion, such as a rotating shaft, a vertically-reciprocating polish rod assembly, and working parts which translate the rotary motion into vertical motion to operate the polish rod assembly.

It is known to use an endless chain and sprocket assembly to translate the rotary motion from the drive mechanism to vertical motion to operate the polish rod assembly. Such endless chain and sprocket assemblies usually include at least two sprockets spaced vertically with the chain in engagement with the sprockets. One of the sprockets is attached to the rotating output shaft of the drive mechanism. A member is usually attached to the endless chain and thus orbits with the chain around the sprockets.

This member may be a sliding arm which slides horizontally in guides, the guides being restricted to vertical movement only. The guides usually slidably engage the derrick structure of the well pumping unit and reciprocate vertically within the derrick structure. A cable sometimes is attached, on one end, to the sliding member or the guides and, on the other end, to the polish rod assembly to translate the orbital movement of the chain into vertical movement on the polish rod assembly.

The member which is attached to the endless chain may also be a rotatable bracket which is fixedly attached to the endless chain on a first end and rotatably attached to the polish rod assembly on a second end. The polish rod assembly must of course be limited to vertical movement. The polish rod assembly is thus oriented along an axis centered with respect to the endless chain and sprocket assembly. As the well pumping unit operates, the first end of the bracket moves in a loop with the endless chain. Since the bracket is rotatably connected to the polish rod assembly, the second end of the bracket reciprocates in a vertical direction. Essentially, the first end of the bracket moves in a loop around the second end, which is reciprocating vertically.

A counterweight is frequently employed in these pumping units to offset the weight of the polish rod assembly. Such counterweights are extremely important in deep wells due to the relatively high weight of the polish rod assembly. The counterweight and the polish rod assembly are usually positioned on opposite sides of a pulley or sprocket. When so positioned, the counterweight offsets the weight of the polish rod assembly to reduce the load which must be raised to operate the polish rod assembly.

It is known to attach the counterweight and the polish rod assembly to the guides or the bracket by cables or chains. In the alternative, the polish rod assembly may be connected to the guides or bracket and the counterweight attached directly to the polish rod assembly (and not directly to the guides or bracket) by a cable or chain.

Examples of the well pumping units described above are disclosed in U.S. Pat. No. 1,599,395 issued to Hards on Sept. 7, 1926, U.S. Pat. No. 1,637,078 issued to Hill on Jul. 26, 1927, U.S. Pat. No. 1,756,089 issued to Hunter on Apr. 29, 1930, U.S. Pat. No. 1,787,164 issued to Parkin on Dec. 30, 1930, U.S. Pat. No. 1,848,530 issued to Hunter on Mar. 8, 1932, U.S. Pat. No. 1,970,620 issued to Park on Aug. 21, 1934, U.S. Pat. 2,292,427 issued to Blackburn on Aug. 11, 1942, U.S. Pat. No. 2,351 183 issued to Blackburn on Jun. 13, 1944, U.S. Pat. No. 2,520,187 issued to Wilshusen et al on Aug. 29, 1950, U.S. Pat. No. 2,555,574 issued to Crawford on Jun. 5, 1951, U.S. Pat. No. 2,987,928 issued to Tedford on Jun. 13, 1961, U.S. Pat. No. 3,153,387 issued to Sadouet on Oct. 20, 1964 and U.S. Pat. No. 3,279,266 issued to Dobbs on Oct. 18, 1966.

It is also known in such well pumping units to have a single member function as the guide and the counterweight, and to attach the polish rod assembly to this combination guide/counterweight. Such a well pumping unit is disclosed in U.S. Pat. No. 2,977,808 issued to Dobbs on Apr. 4, 1961.

In addition, well pumping units have been developed wherein the mechanism translating the rotational motion into vertical motion includes a continuous belt or chain driven by a drive mechanism in a loop around rollers or sprockets, and a pitman arm. One end of the pitman arm is attached to the flexible belt or chain. The other end of the pitman arm is attached to a counterweight assembly. One end of a belt and pulley assembly is attached to the counterweight assembly. The other end of the belt and pulley assembly is attached to the polish rod assembly. Such well pumping units are disclosed in U.S. Pat. No. 4,651,582 issued to Bender on Mar. 24, 1987 and my co-pending application, Ser. No. 048,933, filed May 12, 1987, now abandoned;

All these prior well pumping units, while they may be functional, suffer inefficiencies. Moreover, many of the pumping units may not be as durable as desired due to internal and external stresses generated during operation of the well pumping units.

One method of reducing the stress on a well pumping unit is by using a belt system instead of chains or cables. A well pumping unit employing a belt drive system is disclosed in U.S. Pat. No. 4,519,262 issued to Le et al on May 28, 1985. U.S. Pat. No. 4,651,582 employs belts to connect a counterweight assembly, a pulley assembly and a polish rod assembly.

While the well pumping units discussed above have been steps forward in the technology, there is always a need in this art for a more efficient well pumping unit which generates more fluid from the well per unit of power expended to operate the well pumping unit. Any improvement in efficiency results in great savings in the industry. Moreover, there is always a need in the art for a well pumping unit which is designed to minimize the stresses on the unit as the unit operates. This results in a more durable pumping unit, and also decreases the initial capital expenditures to construct the unit.

This invention fulfills these needs, as well as other needs which will become apparent to those skilled in the art once given this disclosure.

SUMMARY OF THE INVENTION

This invention provides a well pumping unit including a drive motor, a pulley and band assembly, a carriage assembly, a counterweight assembly and a belt and pulley assembly. The pulley and band assembly includes first and second pulleys and a continuous band extending between and engaging the pulleys. The pulleys are spaced vertically and the first pulley is driven by the drive motor. The carriage assembly includes a block base, wheels rotatably attached to the block base and an outer frame. The block base is fixedly connected to the continuous band. The wheels rotatably engage the interior of the frame. The counterweight assembly is fixedly attached to the frame. The belt and pulley assembly has first and second ends, the first end being attached to the counterweight assembly and the second end being attachable to a polish rod assembly.

In some embodiments of this invention, the pulleys are sprockets and the band is a continuous chain.

In further embodiments, the block base and the wheels are located within the frame. The block base and wheels may move horizontally relative to the frame, but not vertically.

In yet other embodiments of this invention, the frame includes top and bottom rails, and the wheels are comprised of pairs of wheels which engage and run along the rails as the well pumping unit operates.

In yet other embodiments, the counterweight assembly is fixedly attached to the top of the frame. The well pumping unit may include a derrick structure and the counterweight assembly may slidably engage the derrick structure to guide the carriage assembly in vertical reciprocation as the well pumping unit operates.

The wheels may include four pairs of wheels on four axles. The four axles may form corners of a square in cross section. One of each of the four pairs of wheels may be located on each side of the block base.

Well pumping units according to this invention have many advantages over prior well pumping units. Among these many advantages are that the well pumping units according to this invention are very efficient, more efficient than any of the prior well pumping units.

Efficiency is very important in the well pumping industry, in fact is critical. The more efficient a well pumping unit is, the less expensive it is to operate the well pumping unit. This reduces the cost per barrel of liquid derived from the well which of course results in direct savings to the well operator. Thus, any improvement in the efficiency of well pumping units is an important advance in the industry.

The well pumping units according to this invention are efficient since the units minimize the energy lost in converting the rotary output force of the drive mechanism to a vertical reciprocating force on the polish rod assembly.

Since less energy is lost, less energy is required to drive the well pumping units according to this invention, as compared to the prior well pumping units.

Another advantage of the well pumping units according to this invention is that the weight of the counterweight which balances the polish rod assembly can be reduced by 50%.

Yet another advantage of well pumping units according to this invention is that the stroke is very long. This increases production from a well. The polish rod of well pumping units according to this invention can be twice as long as conventional polish rods, which also means that the polish rod can carry twice the capacity of oil or other fluid. Thus, for each stroke, twice the amount of fluid is being pumped.

It is also an advantage of this invention that the mechanism converting the rotary output of the drive motor to a vertical reciprocating force on the polish rod assembly is very compact. Thus, the well pumping unit may be of smaller size than well pumping units of other designs which have a comparable stroke.

Further, since the well pumping units according to this invention utilize belts which extend from the counterweights to the polish rod assemblies, this results in less stress on the entire units. The belts are stretchable, and thus absorb some of the shock which results from operation of the well pumping units. This is particularly significant when the polish rod and counterweight assemblies change directions, since this is when the most stress is inflicted on the system. The less shock on a well pumping unit, the more durable the unit is. Essentially, the belt and pulley system acts as a shock absorber between the drive motor and the polish rod assembly, so that each does not transmit damaging vibrations to the other. Specifically, harmonics from the polish rod assembly will be prevented from impacting the band and pulley assembly and the drive motor.

In addition, since the carriage assembly is directly attached to the counterweight assembly which in turn slidably engages the derrick structure and is limited by the derrick structure to vertical movement only, there is minimal turning and twisting of the band. The counterweight assembly in effect guides the band and limits the distortion thereof. This will greatly extend the life of the band, as well as maximize the loss of energy due to the band and pulley assembly.

Also, since the well pumping units according to this invention are so efficient, the units can utilize a smaller motor than prior well pumping units. The use of a smaller motor means that less power is required to operate the units, less maintenance will be involved to keep the motors operating and initial costs involved in constructing the well pumping units are lower.

Further, since the counterweight assembly is directly connected to the carriage assembly, thé acceleration and deceleration of the pumping units at the beginning and end of each half-stroke is very smooth. That is, since the block base of the carriage assembly must travel around the lower and upper pulleys, the counterweight assembly and polish rod assembly will slowly decelerate at the end of each half stroke and slowly accelerate at the beginning of each half stroke.

Specifically, once the block base begins moving around a pulley, the carriage assembly decelerates in the vertical direction since the motion of the block base now also has a horizontal component. As the carriage assembly decelerates vertically, the counterweight assembly and polish rod assembly decelerate at the same rate. The opposite is true after the block base passes directly over or under a pulley, that is, the carriage assembly slowly accelerates in the vertical direction since the motion of the carriage assembly has both horizontal and vertical forces until the block base "clears" the pulley. The counterweight assembly and polish rod assembly accelerate at the same rate the carriage assembly accelerates vertically.

For example, when the block base rounds the upper pulley, the carriage assembly at first decelerates in the vertical direction since the block base also now moves in the horizontal direction. When the block base is directly over the pulley, the vertical movement of the carriage assembly, and thus the counterweight and polish rod assemblies, will stop for an instant. As the block base starts to go downward, around the top pulley, the carriage assembly will slowly accelerate since the block base still is moving horizontally also. Once the block base clears the pulley, all the movement thereof is in the vertical downward direction.

Furthermore, another advantage of well pumping units according to this invention is that because the units are so efficient, and utilize a long stroke, it may be possible to defer other, more expensive methods of fluid recovery which are currently implemented when the current well pumping units are inadequate. Such other methods of recovery include water flooding, sub-pumps and carbon dioxide. The deferment of these alternative method of recovery results in great savings to well operators.

Certain embodiments of this invention will now be described in detail with respect to these Figures, wherein:

DETAILED DESCRIPTION OF THE DRAWINGS

Figure 1:
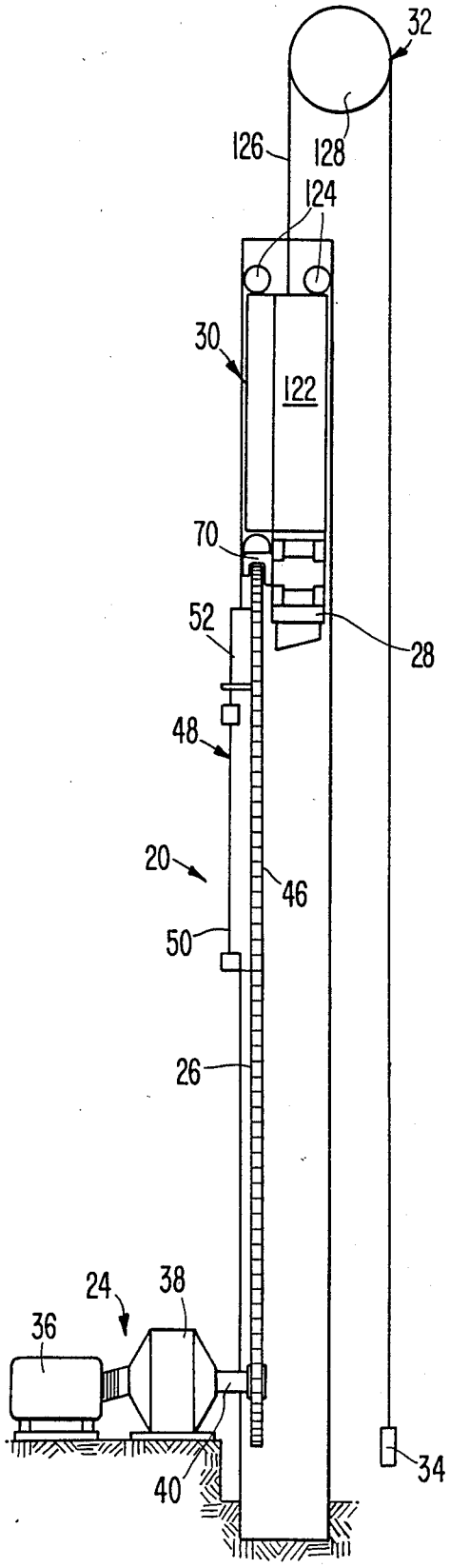
FIG. 1 is a side view illustrating one embodiment of this invention with the counterweight assembly in the up position, and with some of the elements being shown schematically for clarity.
Figure 2:
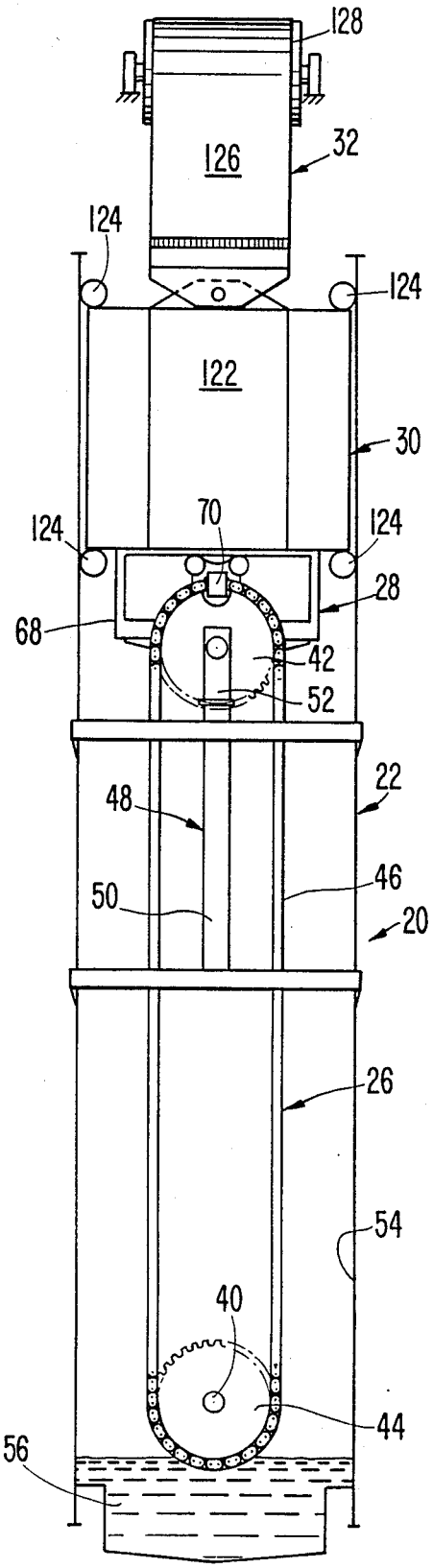
FIG. 2 is a front view of the well pumping unit illustrated in FIG. 1 with the counterweight assembly in the up position, and with some of the elements being shown schematically for clarity.
Figure 3:
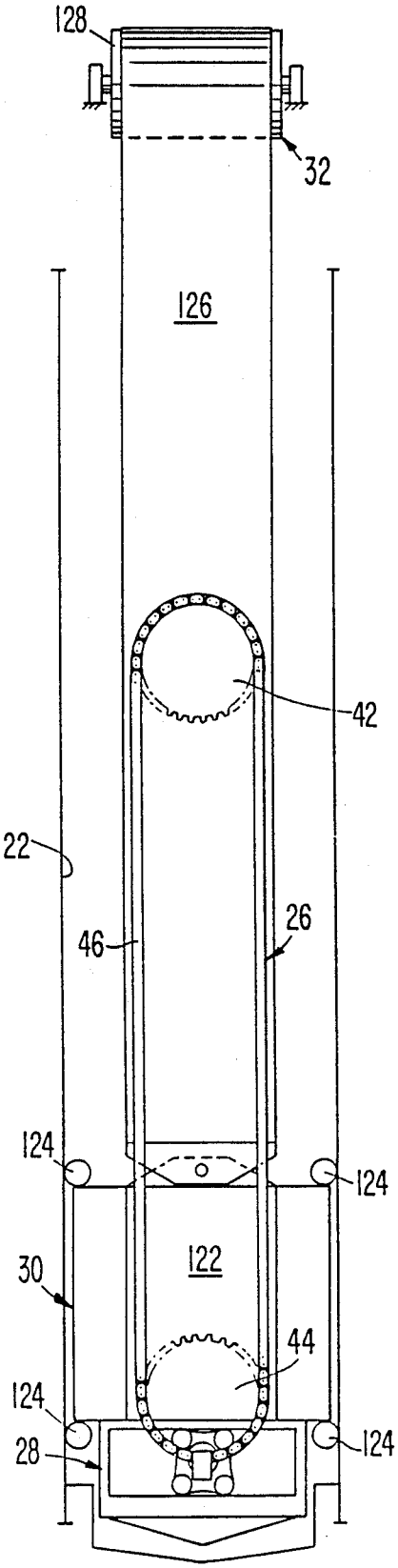
FIG. 3 is a front view of the embodiment of this invention illustrated in FIGS. 1 and 2 with the counterweight assembly in the down position, and with some of the elements being shown schematically for clarity.

Referring to the Figures, in particular FIGS. 1–3, a well pumping unit according to this invention, well pumping unit 20, is illustrated which includes derrick structure 22, drive motor assembly 24, chain and sprocket assembly 26, carriage assembly 28, counterweight assembly 30 and belt and pulley assembly 32. Well pumping unit 20 is designed to operate polish rod assembly 34. Each of the elements of well pumping unit 20 is individually described below.

Derrick structure 22 is of a type common in the well pumping industry. Thus, derrick structure 22 is not illustrated in detail in the Figures. Derrick structure 22 includes many upright members and frame support members which provide a stable framework to support the various other elements of well pumping unit 20.

Derrick structure 22 also includes lubricating bath structure 54 which contains a quantity of lubricating oil, such as oil 56. Chain and sprocket assembly 26 is located within lubricating bath structure 54. Lubricating oil 56 is provided in a quantity such that chain 46 is continuously lubricated as chain 46 orbits around sprockets 42 and 44 (see discussion below).

Drive motor assembly 24 includes drive motor 36, gear box 38 and output shaft 40 (see FIG. 1). All of these items are well known in the well pumping industry, and thus are not described in detail herein. Drive motor 36 operates gears located in gear box 38 to rotate output shaft 40. Thus, the output from drive motor assembly 24 is the rotation of output shaft 40.

Chain and sprocket assembly 26 includes upper sprocket 42, lower sprocket 44, endless chain 46 and chain tensioning device 48. Lower sprocket 44 is fixedly attached to output shaft 40 and thus is driven rotationally as shaft 40 rotates. Upper sprocket 42 is an idler sprocket.

In the embodiment illustrated in the Figures, the axis of rotation of upper sprocket 42 is directly over the axis of rotation of lower sprocket 44. Sprockets 42 and 44 have the same diameter. Endless chain 46 engages sprockets 42 and 44 and thus is driven in an orbital loop around the outer periphery of sprockets 42 and 44.

Chain tensioning device 48 is of the type well known in the industry and thus is not illustrated or described in detail. Basically, chain tensioning device 48 includes arm 50 and sleeve 52. Arm 50 is fixedly attached to cross supports of derrick structure 22. Sleeve 52 is an open-ended cylinder which slidably covers the upper end of arm 50. Upper sprocket 42 is attached to sleeve 52. The position of sleeve 52 relative to arm 50 determines the tension on endless chain 46 since this determines the spacing between sprockets 42 and 44.

Carriage assembly 28 includes block base 58, wheels 60–67, frame 68, swivel knuckle 70 and axles 76–79.

Block base 58 is made of metal and has orifices therethrough to receive axles 76–79 and knuckle 70, as discussed below in more detail. Block base 58 can be of any shape as long as it fits within frame 68. In the embodiment illustrated in the Figures, block base 58 is of generally rectangular shape with convex outer surfaces, surfaces 72–75.

Wheels 60–67 and axles 76–79 are configured in four wheel and axle assemblies. Each wheel and axle assembly includes two wheels and an axle, the wheels being located on opposite sides of block base 58. The axle for each such wheel and axle assembly extends through an orifice in block base 58 to connect the two wheels.

The four wheel and axle assemblies are as follows. The first wheel and axle assembly is comprised of wheels 60 and 61 and axle 76 and is located in the upper left hand corner of block base 58 (when block base 58 is viewed from the front). Wheel 60 is the front wheel and wheel 61 is the rear wheel. The second wheel and axle assembly is comprised of wheels 62 and 63 and axle 77 and is located in the lower left-hand corner of block base 58. Wheel 62 is the front wheel and wheel 63 is the back wheel. The third wheel and axle assembly is comprised of wheels 64 and 65 and axle 78. This assembly is located in the upper right hand corner of block base 58. Wheel 64 is the front wheel and wheel 65 is the back wheel of the assembly. The fourth wheel and axle assembly is comprised of wheels 66 and 67 and axle 79. This wheel and axle assembly is located in the lower right hand corner of base 58. Wheel 66 is the front wheel and wheel 67 is the back wheel of this assembly.

The longitudinal axes of axles 76–79 are perpendicular to the longitudinal axis of belt and pulley assembly 32. Axles 76–79 are positioned, in the embodiment illustrated in the Figures, such that they form the corners of a square when carriage assembly 28 is viewed from the front or the near.

Figure 7A:
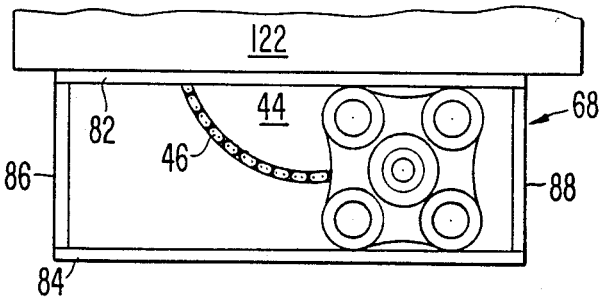
FIGS. 7A, 7B and 7C are sequential rear views of the carriage assembly of the embodiment of this invention illustrated in FIGS. 1–5, illustrating the movement of the block base and wheels of the carriage assembly as the carriage assembly rounds the lower pulley of the band and pulley assembly.
Figure 7B:
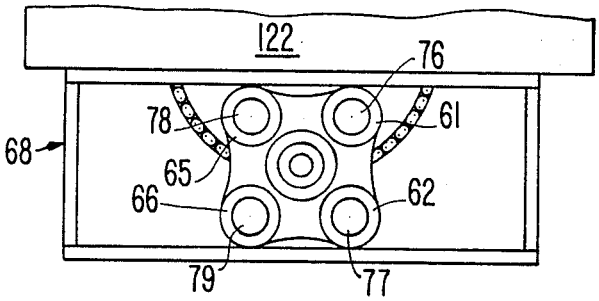
Figure 7C:
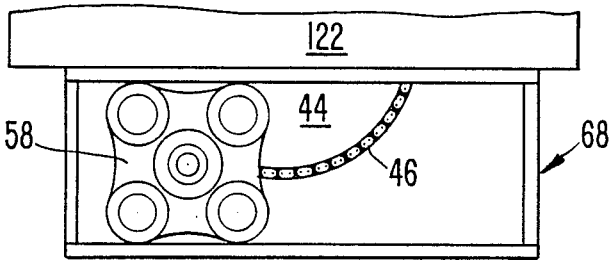
Figure 8:
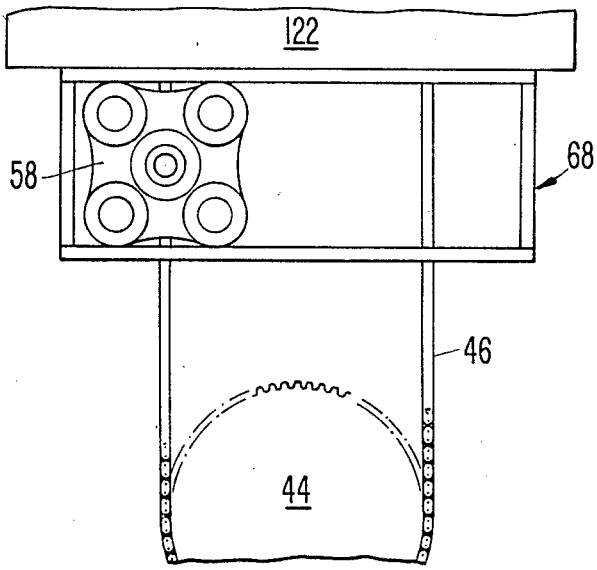
FIG. 8 is a partial rear view of the embodiment of this invention illustrated in FIGS. 1–5, illustrating the carriage when the block base and wheels thereof are located in the left hand side of the frame.

Frame 68 is comprised of upper plate 82, lower plate 84 and side plates 86 and 88 (see FIG. 7A). Plates 82–88 are connected on ends to form an enclosed frame.

Frame 68 also includes top rails 90 and 92 and bottom rails 94 and 96. Top rails 90 and 92 are attached to the underside of upper plate 82. The rails extend the length of upper plate 82 and are spaced in parallel relationship. Likewise, bottom rails 94 and 96 are affixed to the top side of lower late 84. Bottom rails 94 and 96 extend the length of lower plate 84 and are spaced in parallel relationship.

As well pumping unit 20 operates as described below, wheels 60 and 64 engage and run along top rail 90, wheels 61 and 65 engage and run along top rail 92, wheels 62 and 66 engage and run along bottom rail 94, and wheels 63 and 67 engage and run along bottom rail 96.

Figure 4:
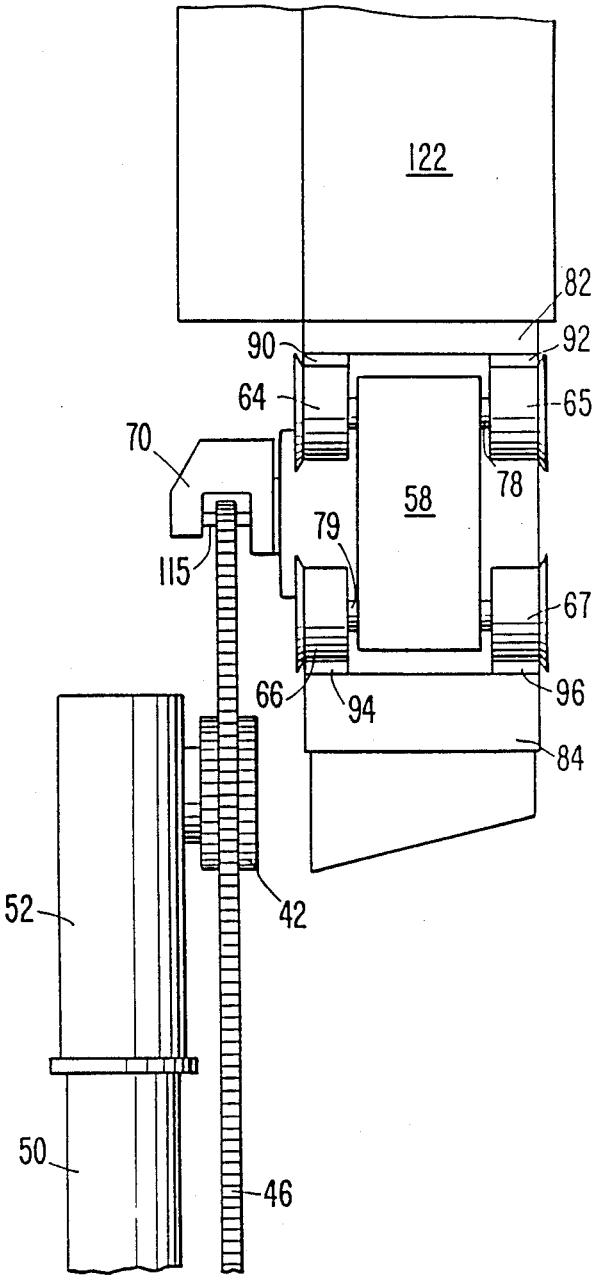
FIG. 4 is a side view of a portion of the embodiment illustrated in FIGS. 1–3, illustrating in part the band and pulley assembly, the carriage assembly, the counterweight assembly and the connection between the band and pulley assembly and the carriage assembly.
Figure 5:
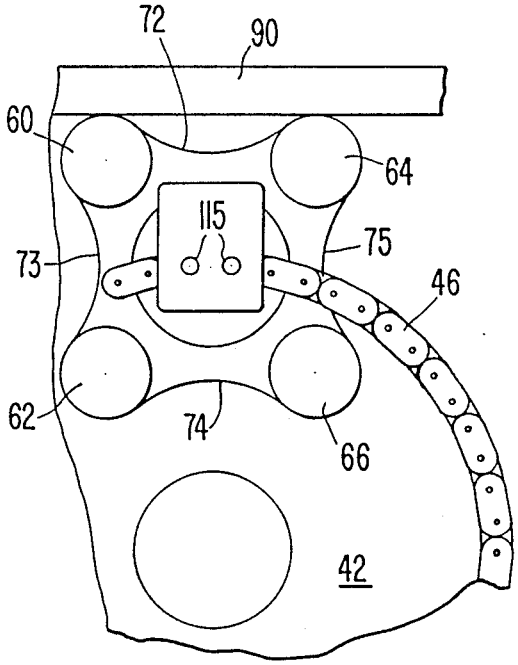
FIG. 5 is a front view of a portion of the embodiment illustrated in FIGS. 1–4, illustrating in part the top pulley, the carriage assembly and the knuckle assembly connecting the band to the carriage assembly.

Wheels 60–67 may have lips on the outer edges which engage the outer surfaces of rails 90–96 to keep block base 58 and wheels 60–67 properly aligned within frame 68 (see FIG. 4).

Figure 6:
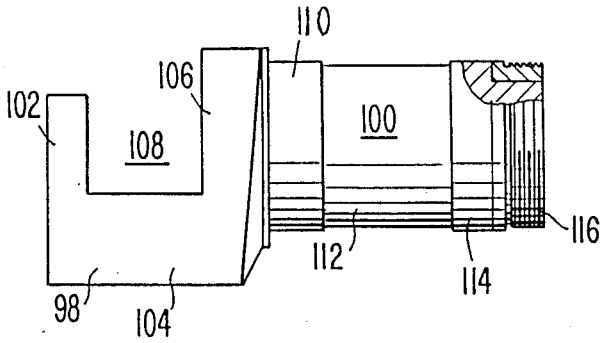
FIG. 6 is a side view of one embodiment of a knuckle which can be employed in the practice of this invention.

Swivel knuckle 70 is illustrated in detail in FIG. 6. Swivel knuckle 70 is an integral member including first portion 98 and second portion 100.

First portion 98 includes outer flange 102, base portion 104 and inner wall 106. Outer flange 102, base portion 104 and inner wall 106 form a substantially U-shaped portion with outer flange 102 and inner wall 106 forming the sides of the "U" and base portion 104 forming the base of the "U". Space 108 is created between outer flange 102, base portion 104 and inner wall 106. First portion 98 is cylindrical and includes inner cylinder 110, recessed cylinder 112 and outer cylinder 114. Cylinders 110–114 have a common axis. Recessed cylinder 112 has a smaller diameter than inner cylinder 110 and outer cylinder 114. Outer cylinder 114 has a threaded portion 116. Threaded portion 116 is provided so that an end retainer can be attached to knuckle 70.

In other embodiments, cylinders 110-114 may be replaced by a continuously convex surface, that is, second portion 100 may have a horizontal cross section of two convex surfaces, facing opposite directions.

Swivel knuckle 70 connects chain 46 to base 58. Second portion 100 is rotatably received within an orifice in the center of block base 58. Roller bearings 120 are provided between second portion 100 and block base 58 so that swivel knuckle 70 is free to rotate within block base 58.

First portion 98 is attached to chain 46 by removing a link from chain 46 and substituting first end 98 in place thereof. First end 98 is attached to endless chain 46 by bolts 115 which pass through outer flange 102, the adjacent free links of chain 48 and into front wall 106. In this manner, swivel knuckle 70 essentially replaces a link of chain 46 and becomes an integral part of chain 46.

Due to this construction, the axis of rotation of knuckle 76 is perpendicular to the longitudinal axis of chain and sprocket assembly 26.

Counterweight assembly 30 includes counterweight 122 and various wheels 124. Counterweight 122 is of any shape, although a rectangular, box shape is illustrated in the Figures. The weight of counterweight 122 is adjustable, and may be adjusted depending on the weight of the polish rod assembly, depth of the well, etc., to achieve maximum efficiency from well pumping unit 20.

Wheels 124 are rotatably attached to counterweight 122 and are positioned at the eight corners of counterweight of 122 (see FIG. 1–3). Wheels 124 engage derrick structure 22 to guide counterweight within derrick structure 22 as well pumping unit 20 operates. As can be determined from the Figures, wheels 124 are arranged in sets to engage side, front and rear members of derrick structure 22 so that the counterweight assembly 30 cannot move forwardly, rearwardly or sideways.

Belt and pulley assembly 32 includes belt 126 and pulley 128. Belt 126 engages pulley 128 which is an idler pulley. Pulley 128 is attached near the top of derrick structure 22. One end of belt 126 is rotatably attached to the top of counterweight assembly 30. The other end of belt 126 is attachable to the top of polish rod assembly 34. Belt 126 is rotatably attached to the top of counterweight assembly 30 to minimize damage to the connection of belt 126 to counterweight assembly 30 resulting from torsional forces on belt 126.

In the embodiment illustrated in the Figures, well pumping unit 20 is designed and constructed such that the longitudinal axis of chain and sprocket assembly 26, the longitudinal axis of counterweight assembly 30 and the longitudinal axis of belt and pulley assembly 32 lie in the same vertical plane, see FIGS. 2 and 3. This alignment greatly increases the efficiency of well pumping unit 20, since the forces are concentrated in a single plane. Sideways movement of these elements is minimized such that little energy is lost due to any such sideways movement.

OPERATION OF THE WELL PUMPING UNIT DISCLOSED IN THE FIGURES

Well pumping unit 20 operates as follows. When drive motor 36 is activated it transmits power to gear box 38 and rotates output shaft 40. Lower sprocket 44 is fixedly attached to output shaft 40 and thus likewise rotates at the same rotational speed.

Endless chain 46 is in engagement with lower sprocket 44, and is thus driven by lower sprocket 44. Upper sprocket 42 is an idler sprocket which is driven by chain 46. Thus, as drive motor 36 operates, endless chain 46 is driven in an orbital loop around sprockets 42 and 44.

As discussed above, chain tensioning device 48 is adjustable to provide the proper tension in endless chain 46. This adjustment is achieved by sliding sleeve 52 relative to arm 50. This determines the spacing between sprockets 42 and 44, and thus provides the desired tension in endless chain 46.

Block base 58 of carriage assembly 28 is attached to endless chain 46 by swivel knuckle 70. Thus, block base 58 travels in the orbital loop around sprockets 42 and 44 with endless chain 46.

Wheels 60–67 are rotatably attached to block base 58 and engage rails 90–96 of frame 68. As block base 58 moves in the orbital loop around sprockets 42 and 44, block base 58 and wheels 60–67 move horizontally with respect to and within frame 68 (see FIGS. 7A–C and 8).

Specifically, assuming that chain 46 is being driven in a clockwise direction around sprockets 42 and 44 (when viewed from the rear), when swivel knuckle 70 is in the right straight portion of the loop, block base 58 is located in the right portion of frame 68. As swivel knuckle 70 begins to pass around the lower right quadrant of lower sprocket 44, block base 58 and wheels 60–67 begin to roll to the left relative frame 68 (see FIG. 7A). As knuckle 70 continues around the lower portion of lower sprocket 44, base 58 and wheels 60–67 will move further to the left relative frame 68 as shown on FIGS. 7B and 7C. During this movement, wheels 60 and 64 engage top rail 90 and roll along it, wheels 61 and 65 engage top rail 92 and roll along it, wheels 62 and 66 engage bottom rail 94 and roll along it and wheels 63 and 67 engage bottom rail 96 and roll along it. Once knuckle 70 passes the lower left hand quadrant of lower sprocket 44, and continues along the left straight portion of the loop of endless chain 46, block base 58 would be located on the left side of frame 68 (see FIG. 8).

The reverse movement of block base 58 relative frame 68 will occur when block base 58 rounds upper sprocket 42, i.e., block base 58 and wheels 60–67 will move from the left side of frame 68 to the right side thereof.

The movement of block base 58 and wheel 60–67 will cause frame 68 to reciprocate vertically as shown in the Figures. When knuckle 70 is travelling downward, lower wheels 62, 63, 66 and 67 push frame 68 downward. When knuckle 70 is travelling upward, upper wheels 60, 61, 64 and 65 push frame 68 upward.

Since counterweight assembly 30 is affixed to frame 68, counterweight assembly 30 reciprocates with frame 68. Wheels 124 engage derrick structure 22 such that derrick structure 22 guides counterweight assembly 30 during this reciprocation.

The first end of belt 126 is attached to the top of counterweight assembly 30. Thus, as counterweight assembly 30 reciprocates, it operates polish rod assembly 34 since polish rod assembly 34 is attached to the other end of belt 126.

Other embodiments, improvements and modifications of this invention will become apparent to those skilled in the art once given this disclosure. Such other embodiments, improvements and modifications are considered to be within the scope of this invention as defined by the following claims:

What is claimed is:

1. A well pumping unit comprising:

a drive motor;

a pulley and band assembly including first and second pulleys and a continuous band extending between and engaging said pulleys, said first pulley being driven by said drive motor, said pulleys being spaced vertically;

a carriage assembly including a block base, wheels rotatably attached to said block base and an outer frame, said block base being swivelly connected to said continuous band, said wheels rotatably engaging the interior of said frame, said block base and said wheels being located within said frame, said block base and said wheels being horizontally movable relative to said frame but not movable vertically relative said frame, said wheels including four pairs of wheels on four axles, the axles being positioned such that in cross-section the four axles form corners of a square, one of said four pairs of wheels being located on each side of said block base;

a counterweight assembly fixedly attached to said frame; and a belt and pulley assembly having first and second ends, said first end being attached to said counterweight, said second end being attachable to a polish rod assembly.

2. A well pumping unit according to claim 1 wherein:

said pulleys are sprockets; and said band is a continuous chain.

3. A well pumping unit according to claim 1 wherein said pulleys are positioned such that the axes of rotation of said pulleys are in the same vertical plane.

4. A well pumping unit according to claim 1 wherein:

said frame includes top and bottom rails;

said wheels including pairs of wheels which engage and run along said rails as said well pumping unit operates.

5. A well pumping unit according to claim 1 wherein said counterweight is fixedly attached to the top of said frame.

6. A well pumping unit according to claim 5 further comprising:

a derrick structure;

said counterweight assembly slidably engaging said derrick structure to guide said carriage assembly in vertical reciprocation as the well pumping unit operates.

7. A well pumping unit according to claim 1 wherein:

said carriage assembly includes a swivel knuckle connector having first and second ends, said first end of said connector being attached to said band, said second end being rotatably received in said block base.

8. A well pumping unit according to claim 7 wherein said second end is received at the center of said block base.

9. A well pumping unit according to claim 1 wherein:

said frame includes top, bottom and side walls and pairs of rails attached to said top and bottom walls;

said wheels engaging said rails as the well pumping unit operates.

10. A well pumping unit according to claim 9 wherein said frame is a continuously enclosed frame.

11. A well pumping unit according to claim 1 wherein the longitudinal axes of said pulley and band assembly, said counterweight assembly and said belt and pulley assembly lie in a common vertical plane.

12. A well pumping unit comprising:

a derrick;

a drive mechanism;

a pulley and band assembly including first and second pulleys and a continuous band extending between and engaging said pulleys, one of said pulleys being driven by said drive mechanism;

a carriage assembly including a block base, wheels rotatably attached to said block base and a frame, said block base being rotatably attached to said band;

said block base and said wheels being positioned within said frame with said wheels rotatably engaging the interior of said frame, said block base and said wheels being located within said frame, said wheels including four pairs of wheels on four axles, the axles being positioned such that in cross-section the axles form corners of a square;

said frame, wheels and block base being of such a size that said block base may move horizontally relative said frame, but not vertically relative said frame, as the well pumping unit operates;

said carriage assembly including a swivel knuckle connector having first and second ends, said first end of said connector being fixedly attached to said band, said second end of said connector being rotatably received by said base;

a counterweight assembly directly affixed to the top of said frame, said counterweight assembly slidably engaging said derrick structure; and a belt and pulley assembly attached to said derrick structure and having first and second ends, said first end being attached to said counterweight assembly, said second end being attachable to a polish rod assembly.

13. A well pumping unit according to claim 12 wherein the longitudinal axes of said pulley and band assembly, said counterweight assembly and said belt and pulley assembly lie in a common vertical plane.

14. A well pumping unit comprising:

a derrick structure;

a drive motor;

a pulley and band assembly, supported by said derrick structure, including first and second pulleys and a continuous band extending between and engaging said pulleys, said first pulley being driven by said drive motor, said pulleys being spaced vertically, said pulley and band assembly having a longitudinal axis extending between the axes of rotation of said pulleys;

a carriage assembly including a block base, wheels rotatably attached to said block base and an outer frame, said carriage assembly being offset horizontally from said longitudinal axis of said pulley and band assembly on one side only of said longitudinal axis, said block base including means for swivelly connecting said block base to said continuous band about a swivel axis perpendicular to the longitudinal axis of said pulley and band assembly, said swivel axis having first and second ends and extending between said pulley and band assembly at said first end and said block base at said second end, said wheels rotatably engaging said outer frame;

a counterweight assembly fixedly attached to said outer frame, said outer frame and said counterweight assembly reciprocally engaging said derrick structure, the reciprocal movement being perpendicular to the swivel axis of said means connecting said block base and said pulley and band assembly and parallel to the longitudinal axis of said pulley and band assembly; and a belt and pulley assembly having first and second ends, said first end being attached to said counterweight, said second end being attachable to a polish rod assembly, said second end being offset horizontally from said carriage assembly and second counterweight assembly;

said carriage assembly and said counterweight assembly being located between and horizontally offset from said pulley and band assembly and said second end of said belt and pulley assembly.

15. A well pumping unit according to claim 14 wherein said pulleys are sprockets and said band is a continuous chain.

16. A well pumping unit according to claim 14 wherein said block base and said wheels are located within said outer frame;

said wheels rotatably engaging the interior of said outer frame.

17. A well pumping unit according to claim 16 wherein said block base and said wheels may move horizontally relative said outer frame, but not vertically relative said outer frame.

18. A well pumping unit according to claim 17 wherein said frame includes top and bottom rails;

said wheels including pairs of wheels which engage and run along said rails as said well pumping unit operates.

19. A well pumping unit according to claim 14 wherein said counterweight assembly is fixedly attached to the top of said outer frame.

20. A well pumping according to claim 19 wherein said counterweight assembly slidably engages said derrick structure to guide said carriage assembly in vertical reciprocation as the well pumping unit operates.

21. A well pumping unit according to claim 14 wherein said means for connecting includes a swivel knuckle connector having first and second ends, said first end of said connector being attached to said band, said second end being rotatably received in said block base.

22. A well pumping unit according to claim 21 wherein said second end of said connector is received at the center of said block base.

23. A well pumping unit according to claim 16 wherein said wheels include four pairs of wheels on four axles, the axles being positioned such that in cross-section the four axles form corners of a square, one of said four pairs of wheels being located on each side of said block base.

24. A well pumping unit according to claim 23 wherein said frame includes top, bottom and side walls and pairs of rails attached to said top and bottom walls;

said wheels engaging said rails as the well pumping unit operates.

25. A well pumping unit according to claim 24 wherein said outer frame is a continuously enclosed frame.

26. A well pumping unit according to claim 14 wherein the longitudinal axes of said pulley and band assembly, said counterweight assembly and said belt and pulley assembly lie in a substantially common vertical plane.

* * * * *